US007594282B2

(12) United States Patent
Shirai

(10) Patent No.: US 7,594,282 B2
(45) Date of Patent: Sep. 29, 2009

(54) WESTERN-STYLE TOILET FACILITY

(75) Inventor: Yasuhiro Shirai, Aichi (JP)

(73) Assignee: Inax Corporation, Tokoname-shi, Aichi (JP)

( * ) Notice: Subject to any disclaimer, the term of this patent is extended or adjusted under 35 U.S.C. 154(b) by 0 days.

(21) Appl. No.: 11/812,712

(22) Filed: Jun. 21, 2007

(65) Prior Publication Data

US 2007/0250998 A1 Nov. 1, 2007

Related U.S. Application Data

(63) Continuation of application No. PCT/JP2005/022852, filed on Dec. 13, 2005.

(30) Foreign Application Priority Data

Dec. 22, 2004 (JP) ..... 2004-371467
Jul. 7, 2005 (JP) ..... 2005-199063

(51) Int. Cl.
*E03D 11/02* (2006.01)

(52) U.S. Cl. ..... 4/328; 4/424

(58) Field of Classification Search ..... 4/421–428, 4/328

See application file for complete search history.

(56) References Cited

U.S. PATENT DOCUMENTS 255,485 A * 3/1882 Boyle ..... 4/328
575,111 A * 1/1897 Harvey ..... 4/328
614,648 A * 11/1898 Wilson et al. ..... 4/328
3,234,565 A * 2/1966 Stott ..... 4/417
5,487,193 A * 1/1996 Hennessy ..... 4/328
5,579,542 A * 12/1996 Hayman ..... 4/374
7,207,073 B1 * 4/2007 Blankenburg ..... 4/431

FOREIGN PATENT DOCUMENTS

JP H07-054388 2/1995
JP H10-096255 4/1998
JP 2002-061262 2/2002

* cited by examiner

*Primary Examiner*—Robert M Fetsuga
(74) *Attorney, Agent, or Firm*—Manabu Kanesaka

(57) ABSTRACT

A pipe work 10 provided with a cleaning control valve $V_1$ is connected to a rim 3 of a toilet main body 1 in a hygienic western-style toilet facility provided with an ejector inhaling and discharging air from a water-discharge channel where there is no possibility for odors and filthy water to be supplied to a toilet bowl in cleaning operation. A branch pipe 11 is branched from more upstream side than the cleaning control valve $V_1$ of the water-supply pipe 10, and is connected to the ejector 20 through a U-shaped pipe 12 and an ejector water-supply valve $V_2$. A discharge outlet of water of the ejector 20 is connected to a second water-discharge channel 7 through a pipe work 13. One end of a negative pressure transmission channel 21 is connected to an air suction inlet 20*a* provided at a throat portion of the ejector 20. The other end of the negative pressure transmission channel 21 is connected to an upper end 5*a* of a rising portion of a first water-discharge channel 5.

3 Claims, 2 Drawing Sheets

WESTERN-STYLE TOILET FACILITY

CROSS REFERENCE TO RELATED APPLICATION

This is a continuation application of PCT/JP2005/022852 filed on Dec. 13, 2005.

FIELD OF THE INVENTION

The present invention relates to a western-style toilet facility provided with a first trap and a second trap, and more specifically, to a western-style toilet facility configured to form a siphon discharge flow early by discharging air from a water-discharge channel at a downstream of the first trap when a toilet bowl is cleaned.

BACKGROUND OF THE INVENTION

A western-style toilet facility provided with a first trap portion continuing into a lower portion of a toilet bowl, the first trap portion, a second trap portion located at a downstream side of the first trap portion, an aspirator for use in generating a negative pressure to generate a siphon action early by discharging air from between the first trap portion and the second trap portion in cleaning the toilet body, is described in Japanese Unexamined Patent Application Publication No. 10-96255.

In the aforementioned Japanese Unexamined Patent Application Publication No. 10-96255, there is a shortcoming that odors and airborne droplets of filthy water flow out toward the toilet bowl, because of that the air aspirated by the aspirator from a water-discharge channel located at a downstream of the first trap portion is configured to flow out toward a rim together with cleaning water for cleaning the toilet body.

In the aforementioned Japanese Unexamined Patent Application Publication No. 10-96255, since the western-style toilet facility is the one that transmits the negative pressure of the aspirator to the water-discharge channel located at the downstream of the first trap portion without change, it is impossible to instantaneously transmit a large amount of the negative pressure to the water-discharge channel located at the downstream of the first trap portion.

SUMMARY OF THE INVENTION

A first object of the present invention is to provide a hygienic western-style toilet facility.

A second object of the present invention is to provide a western-style toilet facility capable of inhaling and discharging air from a water-discharge channel utilizing a large amount of the negative pressure while accumulating the negative pressure of an ejector.

A western-style toilet facility according to a first aspect of the present invention includes a western-style toilet body including a rim and a toilet bowl, a first trap continuing into the toilet bowl, a second trap disposed at a downstream side of the first trap, and an ejector inhaling and discharging air from a water-discharge channel allowing the first trap and the second trap to communicate with each other when the western-style toilet body is cleaned. The western-style toilet facility further includes a negative pressure transmission channel for transmitting negative pressure of the ejector to the water-discharge channel. The ejector is disposed in a manner so as to cause a discharge water flow to flow out to the second trap or a more downstream side than the second trap.

A western-style toilet facility according to a second aspect of the present invention includes a western-style toilet body including the rim and the toilet bowl, the first trap continuing into the toilet bowl, the second trap disposed at the downstream side of the first trap, and the ejector inhaling and discharging the air from the water-discharge channel allowing the first trap and the second trap to communicate with each other when the western-style toilet body is cleaned. The western-style toilet facility further includes a negative pressure transmission channel for transmitting negative pressure of the ejector to the water-discharge channel, a negative pressure tank provided in the middle of the negative pressure transmission channel, and a negative pressure transmission valve being opened at a time when the western-style toilet body is cleaned, while being provided in the negative pressure transmission channel between the negative pressure tank and the water discharge channel.

DETAILED EXPLANATION OF THE PREFERRED MODES OF THE INVENTION

Figure 1A:
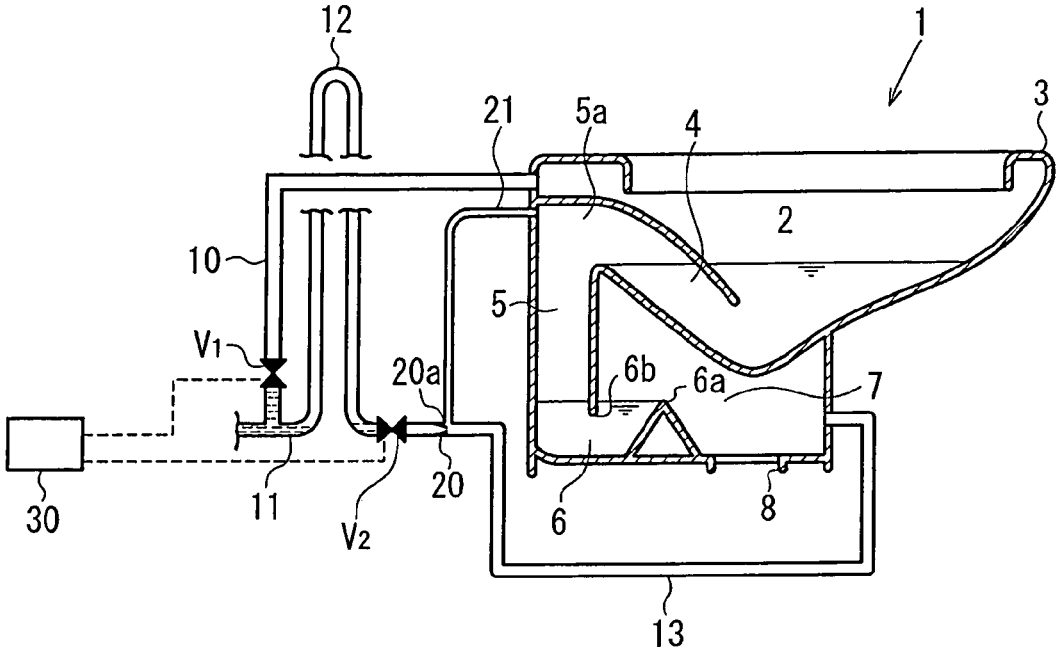
FIG. 1*a* is a cross-sectional view showing a condition when a western-style toilet facility according to an embodiment is in a non-cleaning operation.

In a western-style toilet facility of a first aspect, an ejector is disposed so as to aspirate gas in a water-discharge channel that allows a first trap and a second trap to communicate with each other and to cause the same to flow out to the second trap or a more downstream side therefrom together with a water-discharge flow of the ejector. Thus, by inhaling the gas in the water-discharge channel, a siphon action can be generated early. Further, since odors, airborne droplets of filthy water, and the like in the water-discharge channel are discharged to the second trap and a subsequent portion thereof, the western-style toilet facility is hygienic.

The western-style toilet facility of the first aspect may be provided with a water supply control apparatus for supplying water to the rim and the ejector when the toilet body is cleaned.

The timing for supplying water to the rim and the ejector is arbitrarily controlled by means of the water supply control apparatus, and thereby the toilet body is rapidly and efficiently cleaned.

The western-style toilet facility of the first aspect may be provided with a negative pressure tank provided in the middle of a negative pressure transmission channel, and a negative pressure transmission valve provided in the negative pressure transmission channel between the negative pressure tank and the water-discharge channel and opened at a time when the western-style toilet facility is cleaned.

In this configuration of the first aspect and the western-style toilet facility of the second aspect, the negative pressure tank is provided in the middle of the negative pressure transmission channel, and the negative pressure transmission valve is provided in the negative pressure transmission channel between the negative pressure tank and the water-discharge channel. After forming a negative pressure in the negative pressure tank by means of the ejector in a condition where the negative pressure transmission valve is closed, the negative pressure transmission valve is opened. Thereby, the gas in the water-discharge channel is inhaled and discharged at once, and the siphon action is rapidly and strongly generated.

The western-style toilet facility of the second aspect may be provided with a one-way apparatus that allows the air to flow out from the negative pressure tank to the ejector in the negative pressure transmission channel between the negative pressure tank and the ejector, and that blocks the same to flow in an opposite direction. Thereby, even when a water flow to the ejector is stopped, the negative pressure remains accumulated in the negative pressure tank.

The western-style toilet facility of the second aspect may further be provided with a water-supply pipe for supplying water to the rim of the western-style toilet facility, a cleaning control valve provided in the middle of the water-supply pipe, a branch pipe that branches from a more upstream side than the cleaning control valve in the water-supply pipe, and is connected to the aforementioned ejector, a water-supply valve for the aforementioned ejector, provided in the branch pipe, and a valve control apparatus first forming the negative pressure in the negative pressure tank by opening the water-supply valve for the ejector for a predetermined time preceding to a cleaning operation for the toilet body, and then opening the cleaning control valve and the negative pressure transmission valve.

The control apparatus first forms the negative pressure in the negative pressure tank by opening the water-supply valve for the ejector for a predetermined time preceding to the cleaning operation for the toilet body, and then opening the cleaning control valve and the negative pressure transmission valve. Thereby, the gas in the water-discharge channel is strongly inhaled and discharged, and the siphon action can be rapidly and strongly generated.

Hereinafter, a preferred mode of the present invention is explained in detail with reference to the drawings.

Figure 1B:
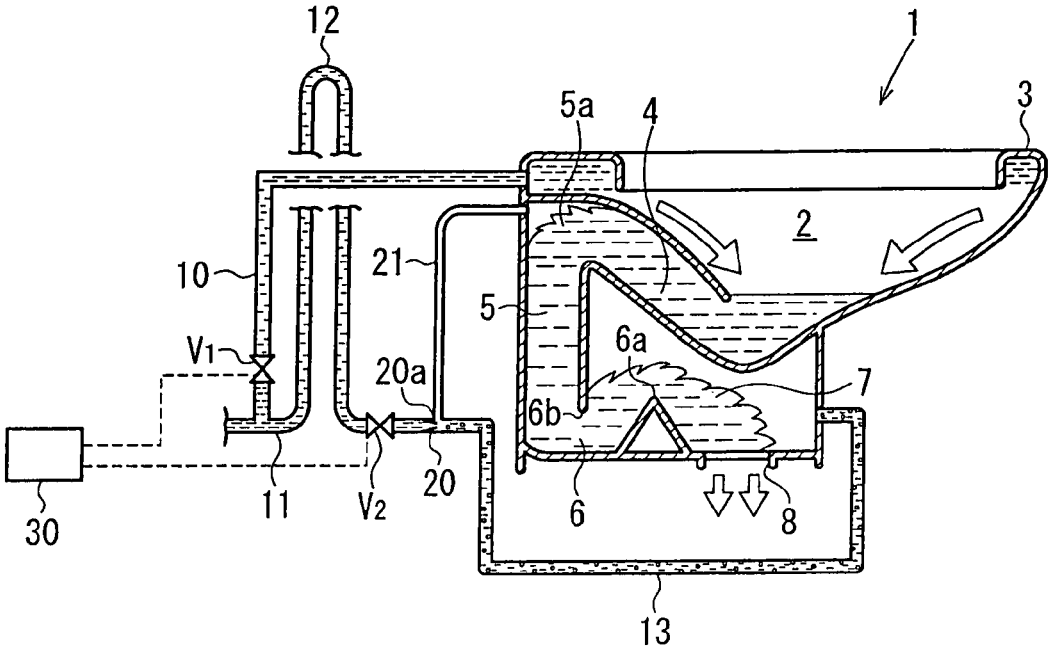
FIG. 1*b* is a cross-sectional view showing a condition when the western-style toilet facility of FIG. 1*a* is in the cleaning operation.

FIG. 1*a* is a cross-sectional view showing a condition when a western-style toilet facility according to an embodiment is not in a cleaning operation, and FIG. 1*b* is a cross-sectional view showing a condition when the western-style toilet facility of FIG. 1*a* is in the cleaning operation. Incidentally, each of black-daubed valves represents the valve in a closed condition, and each of outline valves represents the valve in an open condition.

A rim 3 is provided in an inner periphery of an upper part of a toilet bowl 2 in a ceramic western-style toilet main body 1. A first trap 4 is provided at a lower part of the toilet bowl 2. The fist trap 4 is allowed to communicate with a second trap 6 via a first water-discharge channel 5. The first water-discharge channel 5 is composed of a rising portion that obliquely rises upward from the first trap 4, and a lowering portion continuing into the rising portion and continuing into the second trap 6 while lowering downward.

The second trap 6 is allowed to communicate with a water-discharge outlet 8 via a second water-discharge channel 7. The second trap 6 is formed of a U-shaped channel turning around a lower side of a lowermost portion 6*b* of a pipe wall lower portion of the first water-discharge channel 5, and then reaching a topmost portion 6*a* for use in overflowing. A height of the topmost portion 6*a* of the second trap 6 is configured to be slightly higher than the lowermost portion 6*b*.

A water-supply pipe 10 provided with a cleaning control valve $V_1$ is connected to the rim 3 of toilet main body 1. A branch pipe 11 branches from a more upstream side than the cleaning control valve $V_1$ in the water-supply pipe 10. The branch pipe 11 is connected to an ejector 20 via a U-shaped pipe 12 rising upward in a reverse U-shaped manner, and an ejector water-supply valve $V_2$. A discharge outlet of the water of the ejector 20 is connected to the second water-discharge channel 7 via a pipework 13. The U-shaped pipe 12 prevents discharging water in the second water-discharge channel 7 from flowing upstream to the water-supply pipe 10 side.

The ejector 20 is attached in a direction in which the water supplied from the water-supply pipe 10 is introduced into an upstream end (actuating fluid introducing inlet) via the branch pipe 11, and which the discharging water flow from a downstream end (flowing outlet of the discharging water flow) flows out to the second water-discharge channel 7.

One end of a negative pressure transmission channel 21 is connected to an air suction inlet 20*a* provided at a throat portion of the ejector 20. The other end of the negative pressure transmission channel 21 is connected to an upper end 5*a* of the first water-discharge channel 5.

Figure 2A:
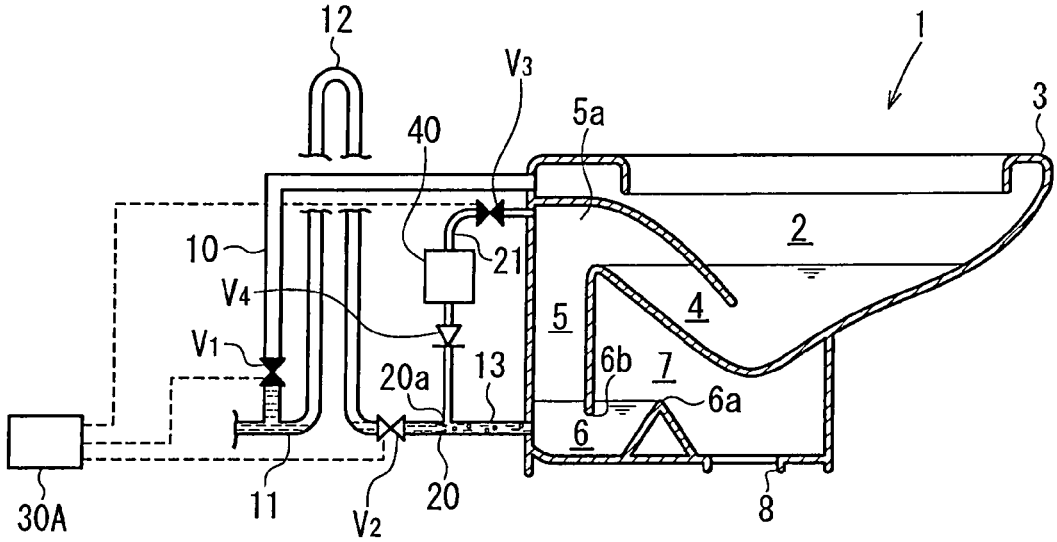
FIG. 2*a* is a cross-sectional view showing a process to form a negative pressure in an inside of a negative pressure tank in the western-style toilet facility according to a different embodiment.
Figure 2B:
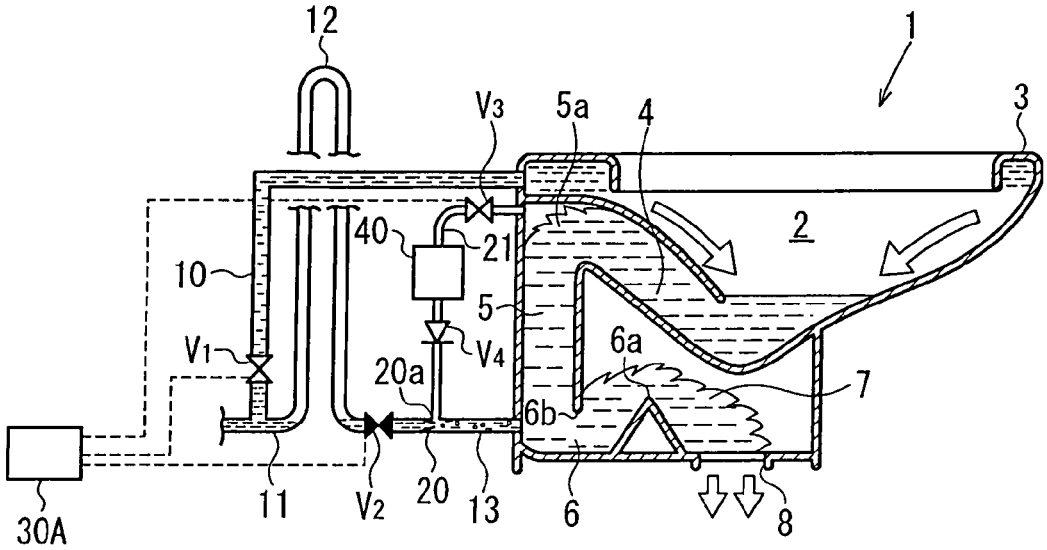
FIG. 2*b* is a cross-sectional view showing a condition when a rim in the western-style toilet facility of FIG. 1*a* is in a cleaning operation.

In FIGS. 1*a* and 1*b*, the pipework 13 for use in releasing the discharging water of the ejector 20 is connected to a front face side of a pedestal portion of the toilet body 1. This is because FIGS. 1*a* and 1*b* are schematic drawings. In fact, the pipework 7 is connected to a place that is difficult to see from outside or to an indistinctive place such as a side surface of the second water-discharge channel 7, a place covered with a skirt portion of the toilet body, or the like. Further, the pipework 13 may be provided in a manner so as to discharge the water in the second trap 6 as shown in FIGS. 2*a* and 2*b*.

The cleaning control valve $V_1$ and the ejector water-supply valve $V_2$ are respectively controlled to open and close by means of a water-supply control device 30. The water-supply control device 30 is disposed in a toilet seat box (illustration is omitted) mounted on an upper surface of a rear portion of the toilet main body 1 in the present embodiment.

An operation of the thus constructed western-style toilet facility is explained next.

[In Non-Cleaning Operation]

In non-cleaning operation, as shown in FIG. 1*a*, the cleaning control valve $V_1$ and the ejector water-supply valve $V_2$ are closed.

[In Cleaning Operation]

When a cleaning switch, not shown, is operated, the water-supply control device 30 opens the cleaning control valve $V_1$ and the ejector water-supply valve $V_2$, as shown in FIG. 1*b*. When these cleaning control valve $V_1$ and the ejector water-supply valve $V_2$ are opened, the cleaning water is supplied into the toilet bowl 2 from the water-supply pipe 10 through the cleaning control valve $V_1$ and the rim 3. An inside of the toilet bowl 2 is cleaned and water supply is discharged into the second water-discharge channel 7 from an end portion of the pipework 13 through the branch pipe 11, the U-shaped pipe 12, the ejector water-supply valve $V_2$, and the ejector 20, from the water-supply pipe 10. The water supply flows into the ejector 20 and thereby the negative pressure is generated at the suction inlet 20*a* of the ejector 20 and the gas in the first water-discharge channel 5 is inhaled and discharged. The inhaled and discharged gas is discharged to the second water-discharge channel 7 while passing through the pipe work 13 after being mixed with the water supply in the pipework 13. The air in the first water-discharge channel 5 is thus inhaled and discharged, and thereby a siphon discharge flow is formed in the first trap 4 early and strongly. At this moment, the air inhaled and discharged from the first water-discharge channel 5 is discharged to the second discharge channel 7, and there is no possibility that the air is diffused in a toilet room.

Even when the airborne droplets of filthy water or the like is stirred together in the inhaled discharge air from the first water-discharge channel 5, the same is discharged to the second water-discharge channel 7, and is not returned to the toilet bowl 2. Therefore, it is extremely hygienic.

After a predetermined time has elapsed from a start of the water flow to the ejector 20, the water-supply control device 30 closes the ejector water-supply valve $V_2$. Thereafter, as is similar to an ordinary siphon-type toilet body, the filthy water in the toilet bowl 2 is discharged to the second water-discharge channel 7 by the siphon action.

[Stopping the Cleaning Operation]

When a predetermined time has elapsed after the ejector water-supply valve $V_2$ is closed, most of all the filthy water in the toilet bowl 2 is discharged, the siphon is broken (the seal water is broken), the water flowing out from the rim 3 is thereafter gradually accumulated at a bottom portion of the toilet bowl 2, and a water-accumulating surface is formed. Consequently, the water-supply control device 30 closes the cleaning control valve $V_1$. Thereby, a sequence of cleaning operation is completed.

In the aforementioned embodiment, although the cleaning control valve $V_1$ and the ejector water-supply valve $V_2$ are simultaneously opened when being in the cleaning operation by the water-supply control device 30, the cleaning control valve $V_1$ may be configured to open after a slight delay from the time the ejector water-supply valve $V_2$ is opened in the cleaning operation. In this case, since inside of the first water-discharge channel 5 is inhaled and discharged preceding to the water supply to the rim 3, the siphon can be formed further earlier.

On the contrary, the ejector water-supply valve $V_2$ may be opened after a slight delay from the time the cleaning control valve $V_1$ is opened. In this case, the cleaning control valve $V_1$ is opened first and the rim is cleaned. The cleaning water raises a head of the toilet bowl 2 while being supplied to the toilet bowl 2, overflows from the first trap 4, supplied to the second trap 6, and forms the seal water in the second trap 6. Next, the ejector water-supply valve $V_2$ is opened. Thereby, the air in the first water-discharge channel 5 is inhaled and discharged, and the siphon is formed.

In the illustrated embodiment, although the lowermost portion 6*b* of the pipe wall of the second trap 6 is configured to have a slightly lower level than the topmost portion (lasher portion) 6*a* of the overflowing side in a manner so as to slightly sink into the seal water in the second trap 6, the lowermost portion 6*b* may be configured to have a slightly higher level than the topmost portion 6*a*. In this case, the water in the second trap 6 is also sucked and drawn toward the first trap 4 side when the air in the first water-discharge channel 5 is inhaled and discharged. Thereby, the lowermost portion 6*b* is sunken in the seal water of the second trap 6, and the first water-discharge channel 5 and the second discharge channel 7 are isolated from each other.

FIG. 2*a* is a cross-sectional view showing a process to form the negative pressure in the inside of the negative pressure tank in the western-style toilet facility according to a different embodiment, and FIG. 2*b* is a cross-sectional view showing a condition when the rim in the western-style toilet facility of FIG. 2*a* is in the cleaning operation.

In the western-style toilet facility according to the present embodiment, a negative pressure tank 40 is provided in the middle of the negative pressure transmission channel 21. A negative pressure transmission valve $V_3$ is provided in the negative pressure transmission channel 21 between the negative pressure tank 40 and the first water-discharge channel 5. A one-way valve $V_4$ serving as a one-way device allowing a fluid to flow into the ejector 20 from the negative pressure tank 40, and blocking the same to flow into a direction opposite thereto, is provided in the negative pressure transmission channel 21 between the negative pressure tank 40 and the ejector 20.

Further, the pipework 13 for use in discharging water in the ejector 20 is connected to the second trap 6 in a manner so as to pour the discharge water into the seal water in the second trap 6.

Furthermore, in addition to the cleaning control valve $V_1$ and the ejector water-supply valve $V_2$, the negative pressure transmission valve $V_3$ is also connected to a valve control device 30A by means of an electric wiring.

Other construction in the western-style toilet facility according to the present embodiment is identical of the western-style toilet facility in FIG. 1*a* and FIG. 1*b*, and the same numerals in FIG. 1*a* and FIG. 1*b* denote the same elements in FIG. 1*a* and FIG. 1*b*.

An operation of the thus constructed western-style toilet facility is explained next.

[In Non-Cleaning Operation]

In non-cleaning operation, the cleaning control valve $V_1$, the ejector water-supply valve $V_2$, and the negative pressure transmission valve $V_3$ are closed.

[In Cleaning Operation]

1. Accumulation of Negative Pressure in the Negative Pressure Tank

When a cleaning switch is operated by a user of the toilet body, as shown in FIG. 2*a*, the valve control device 30A opens the ejector water-supply valve $V_2$ first. Thereby, the air in the negative pressure tank 40 is inhaled by the ejector 20 and the negative pressure is formed in the negative pressure tank 40. Incidentally, since the one-way valve $V_4$ is provided, even when the water flow to the ejector 20 is stopped, the negative pressure remains accumulated in the negative pressure tank 40.

2. Cleaning Operation for the Toilet Body

Next, as shown in FIG. 2*b*, the valve control device 30A closes the ejector water-supply valve $V_2$, and opens the cleaning control valve $V_1$ and the negative pressure transmission valve $V_3$. By opening the cleaning control valve $V_1$, the water is supplied from the water-supply pipe 10 to the toilet bowl 2 through the rim 3, and the rim is cleaned. Moreover, by opening the negative pressure transmission valve $V_3$, the air in the first water-discharge channel 5 is inhaled into the negative pressure tank 40, and the siphon action is rapidly and strongly generated. Incidentally, the negative pressure transmission valve $V_3$ is closed after a predetermined time has elapsed, and the filthy water is configured not to flow into the negative pressure tank 40.

By the siphon discharge flow formed in a manner as described above, the filthy water in the toilet bowl 2 is discharged to the second discharge channel 7. Later on, most part of the filthy water in the toilet bowl 2 is discharged, and the siphon of the first trap 4 is broken. Thereafter, the water is gradually accumulated in the bottom portion of the toilet bowl 2 by the water from the rim 3.

3. Stopping

Consequently, the valve control device 30A closes the cleaning control valve $V_1$, and the cleaning operation is completed. The water remaining in the rim 3 flows into the toilet bowl 2 and a sufficient accumulated water surface is formed.

In this embodiment, the air inhaled out from the first water-discharge channel 5 to the negative pressure tank 40 is discharged to the second trap 6 side at a negative-pressure accumulating process in the negative pressure tank performed next time the toilet body is cleaned. The airborne droplets stirred together with the air from the first water-discharge channel 5 are discharged in a similar manner as described above.

Incidentally, in the present embodiment, at a time the rim is cleaned, as shown in FIG. 2*b*, although the cleaning control valve $V_1$ and the negative pressure transmission valve $V_3$ are simultaneously opened, the siphon may be formed earlier by opening the negative pressure transmission valve $V_3$ slightly earlier, and inhaling the inside of the trap 4 earlier. On the contrary, the rim may be cleaned and the head may be raised by opening the cleaning control valve $V_1$ earlier.

In the present embodiment, although the ejector water-supply valve $V_2$ is closed for preventing the reverse flow when the rim is cleaned, the same may be kept opened.

In the present embodiment, although a starting operation of the ejector 20 is performed by opening the ejector water-supply valve $V_2$ by receiving an operating signal of the cleaning switch, the starting operation of the ejector 20 may be performed by opening the valve $V_2$ when the user is detected by a human body detecting sensor or a seating sensor.

The aforementioned embodiment is an example of the present invention, and the present invention is not limited to the aforementioned embodiment.

For example, in FIG. 1*a* and FIG. 1*b*, although the water-supply control device 30 is provided for opening and closing the cleaning control valve $V_1$ and the ejector water-supply valve $V_2$, a valve apparatus, in which a flush valve, the cleaning control valve $V_1$, and the ejector water-supply valve $V_2$ are integrally formed, and the cleaning control valve $V_1$, and the ejector water-supply valve $V_2$ are mechanically opened for a predetermined time by means of an operation of the flush valve, may be used. The second trap may be a flapper valve.

In FIG. 2*a* and FIG. 2*b*, the one-way valve $V_4$ may be omitted. In this case, when the toilet body is cleaned, the ejector water-supply valve $V_2$ is opened first, and the negative pressure is formed in the negative pressure tank 40 by means of suction force of the ejector 20. Then, the negative pressure transmission valve $V_3$ and the cleaning control valve $V_1$ are opened, the water is caused to flow into the first water-discharge channel 5 and the air in the first water-discharge channel 5 is inhaled into the negative pressure tank 40, and the siphon discharge flow is generated.

The invention claimed is:

1. A western-style toilet facility comprising:

a western-style toilet body including;

a rim and a toilet bowl, a first trap continuing into the toilet bowl, a second trap disposed at a downstream side of the first trap, a water-discharge channel for communicating the first trap and the second trap;

an ejector inhaling and discharging air from the a water-discharge channel when the western-style toilet body is cleaned;

a negative pressure transmission channel for transmitting negative pressure of the ejector to the water-discharge channel;

a negative pressure tank provided in a middle of the negative pressure transmission channel;

a negative pressure transmission valve opened when the western-style toilet body is cleaned, said negative pressure transmission valve being provided in the negative pressure transmission channel between the negative pressure tank and the water discharge channel, a water-supply pipe for supplying water to the rim;

a cleaning control valve provided in a middle of the water-supply pipe;

a branch pipe branched from the water-supply pipe at a more upstream side than the cleaning control valve, and connected to the ejector;

an ejector water-supply valve for the ejector provided in the branch pipe; and a valve control device first forming negative pressure in the negative pressure tank by opening the ejector water-supply valve for the ejector for a predetermined time preceding to the cleaning operation for the toilet body, and then opening the cleaning control valve and the negative pressure transmission valve.

2. A western-style toilet facility comprising:

a western-style toilet body including;

a rim and a toilet bowl, a first trap continuing into the toilet bowl, a second trap disposed at a downstream side of the first trap, and a water-discharge channel for communicating the first trap and the second trap;

an ejector inhaling and discharging air from the a water-discharge channel when the western-style toilet body is cleaned;

a negative pressure transmission channel for transmitting negative pressure of the ejector to the water-discharge channel, the ejector being disposed in a manner so as to cause a discharge water flow to flow out to the second trap or a more downstream side than the second trap;

a negative pressure tank provided in a middle of the negative pressure transmission channel;

a negative pressure transmission valve provided in the negative pressure transmission channel between the negative pressure tank and the water discharge channel and opening when the western-style toilet body is cleaned;

a water-supply pipe for supplying water to the rim of the western-style toilet body;

a cleaning control valve provided in a middle of the water-supply pipe;

a branch pipe branched from the water-supply pipe at a more upstream side than the cleaning control valve, and connected to the ejector;

an ejector water-supply valve for the ejector provided in the branch pipe; and a valve control device first forming negative pressure in the negative pressure tank by opening the ejector water-supply valve for the ejector for a predetermined time preceding to the cleaning operation for the toilet body, and then opening the cleaning control valve and the negative pressure transmission valve.

3. The western-style toilet facility according to claim 2, further comprising a one-way device allowing air to flow into the ejector from the negative pressure tank, and blocking the same to flow into a direction opposite thereto, said one-way device being provided in the negative pressure transmission channel between the negative pressure tank and the ejector.

* * * * *